US007699645B1

(12) United States Patent
Montena et al.

(10) Patent No.: US 7,699,645 B1
(45) Date of Patent: Apr. 20, 2010

(54) CONNECTOR FOR MULTISTRANDED INSULATED CONDUCTOR CABLE

(75) Inventors: Noah Montena, Syracuse, NY (US); Stephen J. Skeels, Manlius, NY (US)

(73) Assignee: John Mezzalingua Assoc., Inc., E. Syracuse, NY (US)

( * ) Notice: Subject to any disclaimer, the term of this patent is extended or adjusted under 35 U.S.C. 154(b) by 9 days.

(21) Appl. No.: 12/254,073

(22) Filed: Oct. 20, 2008

(51) Int. Cl.
*H01R 13/58* (2006.01)

(52) U.S. Cl. ..... 439/427; 439/462

(58) Field of Classification Search ..... 439/427, 439/428, 394, 462, 461; 174/655
See application file for complete search history.

(56) References Cited

U.S. PATENT DOCUMENTS 4,352,240 A 10/1982 Komada
4,944,686 A 7/1990 Gertz
5,775,934 A 7/1998 McCarthy
5,851,124 A 12/1998 Young et al.
5,934,937 A * 8/1999 McCarthy ..... 439/583
6,062,897 A 5/2000 McCarthy
6,123,567 A 9/2000 McCarthy
6,773,295 B2 8/2004 Lindemann et al.
6,848,934 B1 2/2005 McCarthy
7,097,486 B2 * 8/2006 Parsons ..... 439/291
7,121,872 B1 * 10/2006 Hanks ..... 439/427

* cited by examiner

*Primary Examiner*—Phuong K Dinh
(74) *Attorney, Agent, or Firm*—Melissa Bitting

(57) ABSTRACT

An electrical connector for a multistranded insulator conductor cable having an elastomeric compression sleeve and a clamping member configured to compress radially inwardly against the cable as a compression member is axially advanced towards the connector body to secure the cable in the connector. The compression member assembly is configured to accommodate a variety of cable insulative sleeve thicknesses and center conductor gauges.

14 Claims, 3 Drawing Sheets

CONNECTOR FOR MULTISTRANDED INSULATED CONDUCTOR CABLE

FIELD OF THE INVENTION

The invention relates generally to electrical connectors and, more particularly, to electrical connectors for coupling a multistranded insulator conductor cable to an equipment port or equipment terminal. The connector described hereinafter does not require the cable insulation to be stripped from the end of the cable prior to installation and can be used for cables with a wide range of insulative sleeve thicknesses.

BACKGROUND OF THE INVENTION

Multistranded insulator conductor cable may be used to transmit electrical power (e.g., battery cables) or communication signals (e.g., speaker wires). Multistranded conductor cables typically include a center conductor made of a series of copper wire strands of varying gauges surrounded by an insulative sleeve of varying thicknesses. A wide variety of electrical wire connectors have been provided for terminating multistranded conductor cables. In a typical connector, an end of the cable is stripped of insulation to expose the center conductor. The bare conductor is then inserted into a connector where it is soldered or clamped to the connector. However, these connectors require additional stripping and crimping tools as well as soldering or multiple clamping elements.

Some connectors exist that do not require the cable to be stripped of insulation prior to installation. Representative of this type of connector are described in U.S. Pat. Nos. 5,775,934 and 7,121,872. However, these connectors can only be used for a conductor cable with a specific insulative sleeve thickness. These connectors do not overcome the problem associated with accommodating conductor cables with a wide variety of insulative sleeve thicknesses.

Accordingly, a new connector for a multistranded insulator conductor cable is needed that does not require an end of the cable to be stripped of insulation and can also accommodate conductor cables with a wide variety of insulative sleeve thicknesses.

SUMMARY OF THE INVENTION

The invention is a connector for connecting an end of a multistranded insulated conductor cable, the cable having a multistranded center conductor surrounded by an insulative sleeve, the connector comprising: a connector body having a first end and a second end, the first end having defined thereon a threaded portion and the second end having a coaxial bore defined therein; a contact member located at the first end, the contact member configured to engage the multistranded center conductor; a conductive pin located within the coaxial bore, the conductive pin configured to establish conductivity between the multistranded center conductor and the equipment terminal; a compression member having a compression member internal passageway disposed therein, a portion of the internal passageway configured to operate with the threaded portion of the first end of the connector body; an elastomeric compression sleeve disposed within a portion of the compression member internal passageway, the compression sleeve having a compression sleeve internal passageway disposed therein; and, a clamping member disposed within a portion of the compression sleeve internal passageway, whereby axial advancement of the compression member on the connector body second end simultaneously causes the contact member to engage the multistranded center conductor and the elastomeric compression sleeve and clamping member to compress radially inwardly against the insulative sleeve to secure the cable within the connector.

Additionally, the invention is a compression member assembly for securing a multistranded insulated conductor cable within a connector, the cable having a center conductor surrounded by an insulative sleeve, the connector having a connector body, the connector body having a coaxial bore disposed therein, a conductive pin located within the coaxial bore, a contact member located at one end of the connector body, the compression member assembly comprising: a compression member attached to the connector body, the compression member having an internal passageway defined therein; an elastomeric compression sleeve disposed within a portion of the compression member internal passageway, the elastomeric compression sleeve having a first end and a second end and an elastomeric compression sleeve internal passageway defined therein; and, a clamping member disposed within the elastomeric compression sleeve internal passageway, the clamping member having a first diameter and a second diameter, a first sloped surface extending between the first diameter and the second diameter, the second diameter being smaller than the first diameter, whereby axial advancement of the compression member on the connector body simultaneously causes the contact member to engage the center conductor and the elastomeric compression sleeve and clamping member to compress radially inwardly against the insulative sleeve to secure the cable within the connector.

The invention further includes a method of securing a multistranded insulated conductor cable within a connector, the cable having a center conductor surrounded by an insulative sleeve, the connector having a connector body, the connector body having a coaxial bore defined therein, a conductive pin located within the coaxial bore, a contact member located at one end of the connector body, the connector further having a compression member assembly comprising: a compression member attached to the connector body, the compression member having a compression member internal passageway defined therein; an elastomeric compression sleeve disposed within a portion of the compression member internal passageway; and, a clamping member disposed within the elastomeric compression sleeve; the method comprising the steps of: inserting the cable into the compression member assembly; attaching the compression member assembly to the connector body; and, axially advancing the compression member on the connector body to simultaneously cause the contact member to engage the center conductor and the compression sleeve and clamping member to compress radially inwardly against the insulative sleeve to secure the cable within the connector.

The invention is a connector for connecting an end of a multistranded insulated conductor cable, the cable having a multistranded center conductor surrounded by an insulative sleeve, the connector comprising: a connector body having a first end and a second end, the first end having defined thereon a threaded portion and the second end having a coaxial bore defined therein; a contact member located at the first end, the contact member configured to engage the multistranded center conductor; a conductive pin located within the coaxial bore, the conductive pin configured to establish conductivity between the contact member and the connector body; a compression member having a compression member internal passageway disposed therein, a portion of the internal passageway configured to operate with the threaded portion of the first end of the connector body; an elastomeric compression sleeve disposed within a portion of the compression member internal passageway, the compression sleeve having a compression sleeve internal passageway disposed therein; and, a clamping member disposed within a portion of the compression sleeve internal passageway, whereby axial advancement of the compression member on the connector body second end simultaneously causes the contact member to engage the multistranded center conductor cable and the elastomeric compression sleeve and clamping member to compress radially inwardly against the insulative sleeve to secure the cable within the connector.

Other objects and features of the invention will become apparent as the description proceeds, especially when taken in conjunction with the accompanying drawings illustrating the invention, of which there are 3 sheets of drawings.

DESCRIPTION OF THE PREFERRED EMBODIMENT(S)

Figure 1:
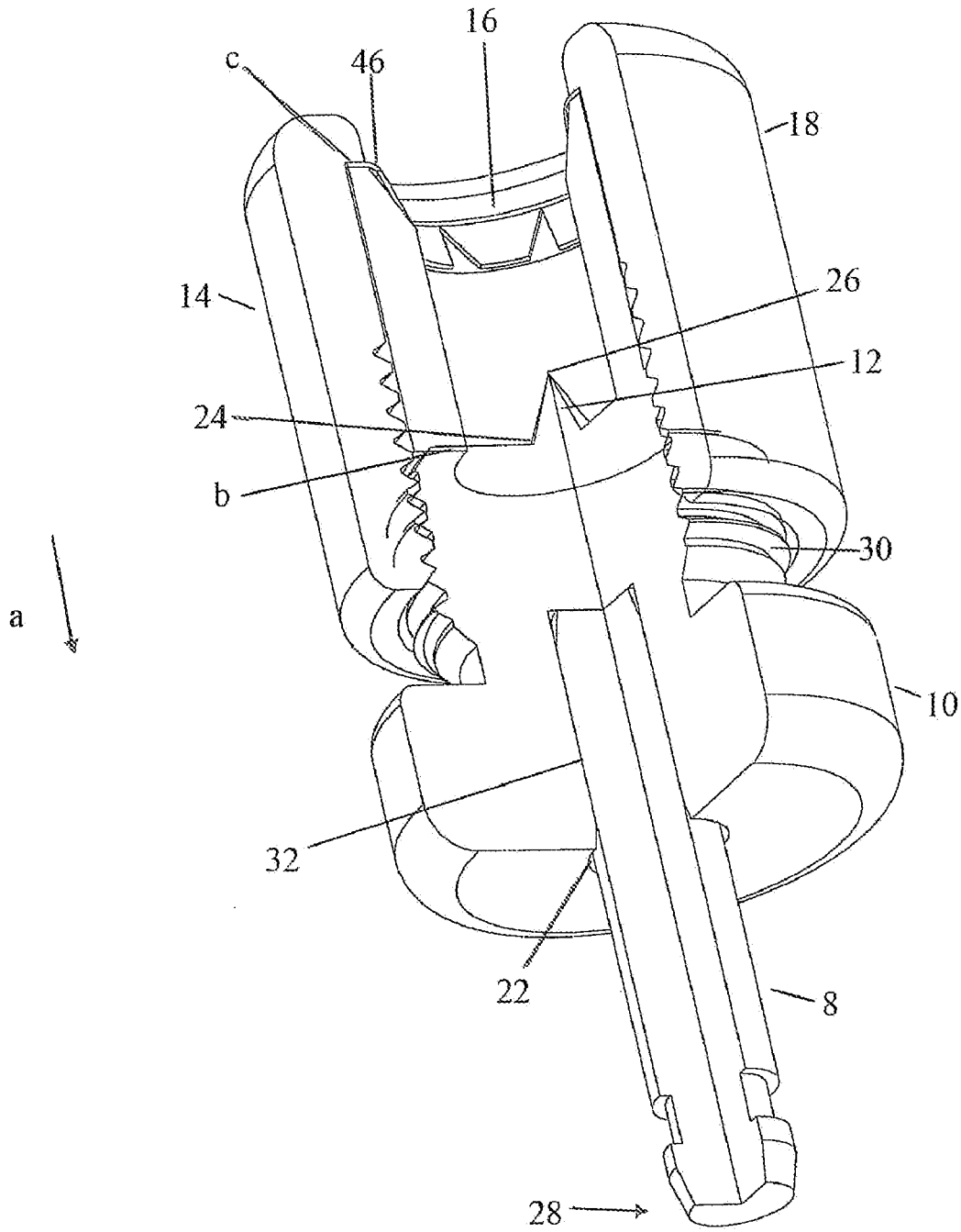
FIG. 1 is a perspective, partial cross-sectional view of the cable connector as described.
Figure 2:
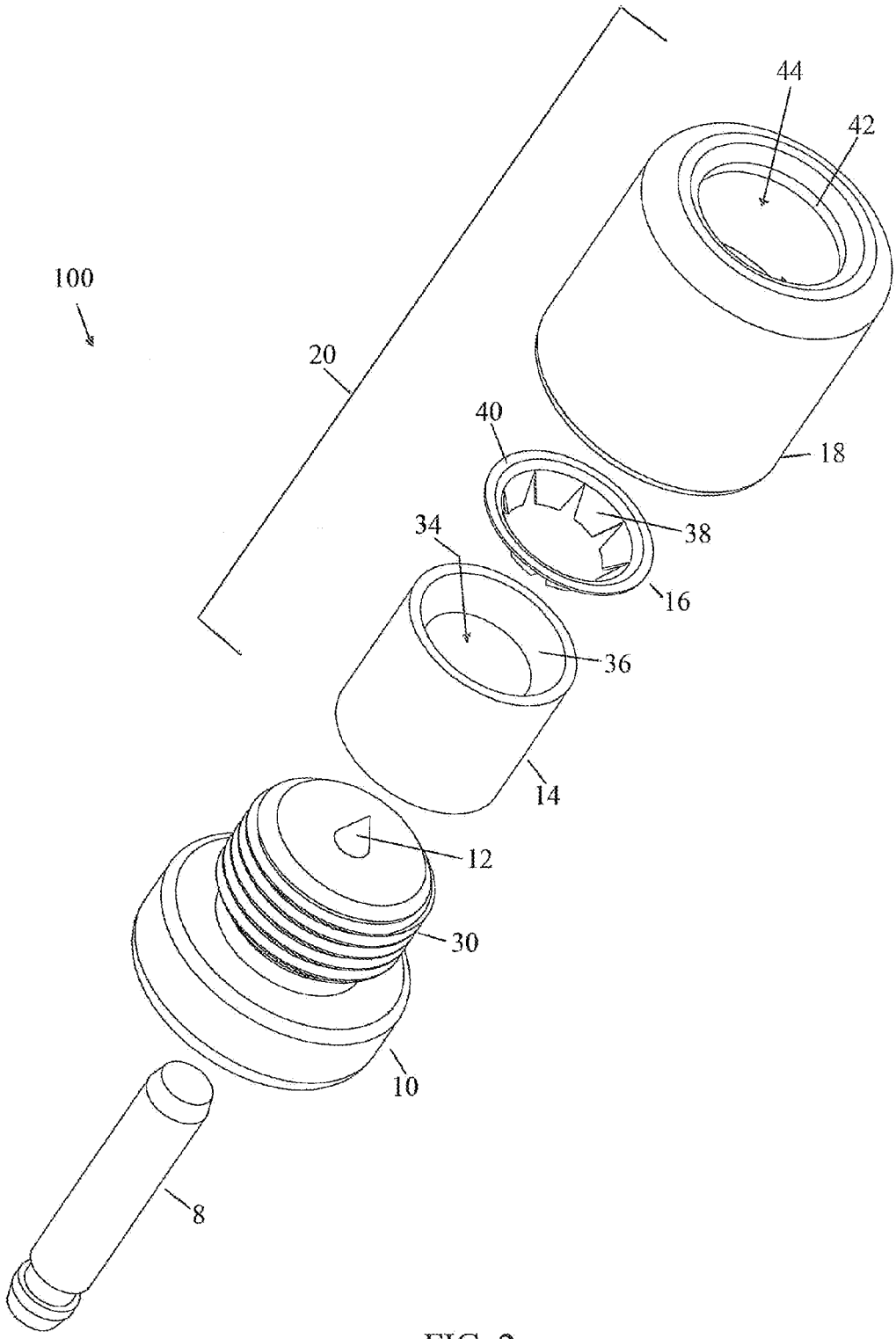
FIG. 2 is an exploded, perspective view of the connector of FIG. 1.

The embodiment depicted in FIGS. 1-2 provides an electrical connector 100 having a connector body 10, conductive pin 8, contact member 12 and compression assembly 20. Electrical connector 100 may be used for connecting a multistranded insulator conductor cable 200 to a corresponding equipment port or equipment terminal (not shown). Cable 200 is often used in the transmission of power (such as battery cables) and communication signals (such as speaker wires), but electrical connector 100 may be used to terminate cables of other types. As will be described in further detail below, an end of cable 200 is inserted into electrical connector 100. Compression assembly 20 is axially advanced towards connector body 10, simultaneously causing contact member 12 to engage or pierce center conductor 210 and compression sleeve 14 and clamping member 16 to compress radially inwardly against insulative sleeve 220 of cable 200 to secure cable 200 within electrical connector 100. This is completed without stripping the insulation from cable 200 and without specialized tools or solder. Electrical connector 100 also accommodates cables with a wide variety of insulative sleeve thicknesses.

Figure 3:
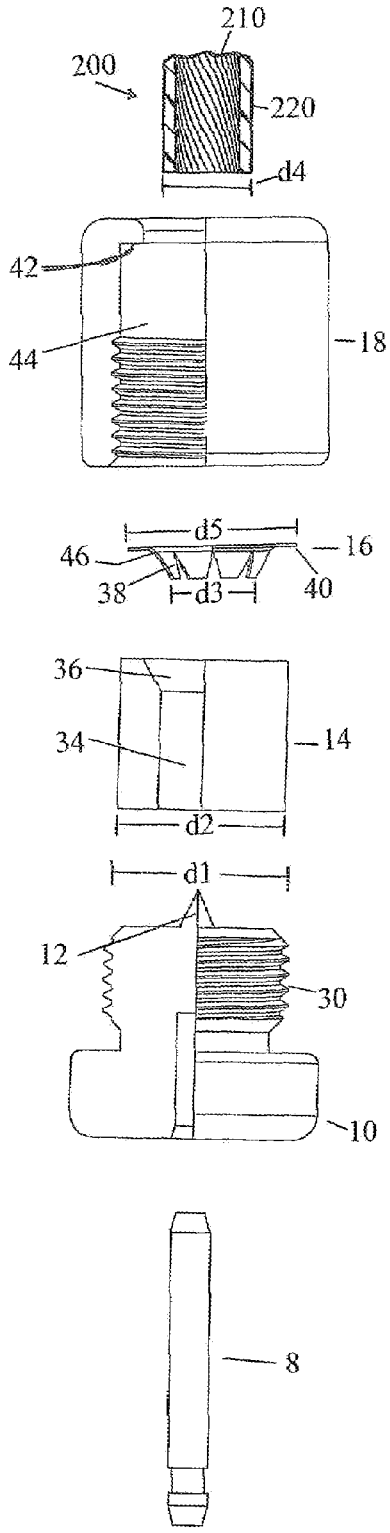
FIG. 3 is an exploded, partial cross-sectional view of the connector of FIG. 1 and a cross-sectional view of the cable as described.

As shown in FIG. 3, multistranded insulator conductor cable 200 has a center conductor 210 that may have a series of copper wire strands of varying gauges. The electrical connector depicted in FIGS. 1-3 may be used for center conductors ranging from 16 gauge to 12 gauge wire strands. Center conductor 210 is surrounded by an insulative sleeve 220 that may be of varying thicknesses. Cable 200 has an outer diameter $d_4$. $D_4$ varies based on the gauge of the wire strands of the center conductor 210 and the thickness of the insulative sleeve 220.

As shown in FIGS. 1-2, connector body 10 has a substantially cylindrical bore 22 extending along a longitudinal axis depicted at "a." Connector body 10 has a bottom end 24, the center from which extends a contact member 12. Contact member 12 may be pointed and sloped from its point of attachment at 24 to its point 26. One of ordinary skill in the art would understand that contact member 12 may take various shapes as long as it engages or pierces the cable adequately to establish conductivity between the system components, including center conductor/equipment terminal and contact member/connector body.

Bore 22 may take shapes other than the substantially cylindrical bore shown; it can, for example, take on a prismatic shape. The embodiment depicted in FIGS. 1-2 has sidewalls 32 that are parallel to the axis "a," such that the cross-section of the bore is the same at the opening as it is at is bottom.

A portion of the second end of the connector body 10 has external threads 30 for affixing compression assembly 20. In other embodiments, these threads can be replaced with other means of affixing compression assembly 20 to the body 10, such as snap rings and grooves or a bayonet-style connection. In a bayonet-style connection, projections may be formed on the outer surface of body 10 that fit into grooves formed in compression member 18. In this configuration, the compression assembly is first moved axially towards the body and then twisted to lock it in place. The second end of the connector body 10 has an outer diameter $d_1$.

Conductive pin 8 is located within cylindrical bore 22. First end 28 of conductive pin 8 is configured for insertion into a corresponding equipment terminal or equipment port of an electronic device. Conductive pin 8 establishes conductivity between the electronic device and the cable. Other possible conductive pin configurations include banana plug or spade-shaped (not shown).

Compression assembly 20 includes a compression sleeve 14, clamping member 16 and compression member 18. Compression sleeve 14 is substantially cylindrical in shape and may be made from an elastomeric material, thereby allowing the sleeve to conform, through radial compression, to cables of varying diameters $d_4$. Compression sleeve 14 has a throughbore 34 extending along longitudinal axis "a." The first end of compression sleeve 14 has an outer diameter $d_2$ that is equal to or smaller than $d_1$. Upon full engagement of compression assembly 20 with body 10, the first end of compression sleeve 14 engages the second end of body 10 at interface "b." A portion of throughbore 34 at the second end of body 10 has a frustoconical surface 36 configured to receive clamping member 16.

Clamping member 16 has a generally frustoconical shape. A first end of clamping member 16 has an outer diameter $d_3$ that is smaller than an outer diameter $d_5$ of the second end of clamping member 16. A sloped surface extends between outer diameters $d_3$ and $d_5$. Clamping member 16 is segmented into a plurality of fingers or leaves 38 configured to grip the insulative sleeve 220 of cable 200 as compression assembly 20 is axially advanced toward connector body 10. Fingers 38 are configured to compress radially inwardly against the insulative sleeve 220 of the cable as compression assembly 20 is axially advanced toward connector body 10; however, fingers 38 will create a binding force on the cable if the cable is pulled in the opposite direction of "a." This helps to prevent the cable from being pulled out of the connector. The second end of clamping member 16 is unsegmented to aid in the compressibility of the smaller end $d_3$ around cable 200 as compression assembly 20 is axially advanced toward the connector body 10 along "a." The second end of clamping member 16 has a flanged portion 40 to engage the first end of compression sleeve 14 and a shoulder portion 42 of compression member 18 at interface "c."

Compression member 18 is substantially cylindrical in shape and has a throughbore 44. A portion of throughbore 44 at the first end of compression member 18 is threaded to engage external threads 30 of body 10. Additionally, the portion of throughbore 44 at the first end of compression member 18 may have snap grooves or bayonet-style grooves as described previously for engaging connector body 10. The second end of compression member 18 has a shoulder or flanged portion 42 configured to contain compression sleeve 14 and clamping member 16 within throughbore 44.

In operation, clamping member 16 is inserted into surface 36 of compression sleeve 14. Compression sleeve 14 is then inserted into throughbore 44 of compression member 18 until the flanged portion 40 of the second end of clamping member 16 engages the first end of compression sleeve 14 and a shoulder portion 42 of compression member 18 at interface "c." An end of cable 200 is cut substantially orthogonal to its axis. Cable 200 is then inserted into compression assembly 20.

The cable and compression assembly 20 is then attached to body and axially advanced along longitudinal axis "a" by threading compression member 18 to external threads 30 of body 10. As compression member 18 is axially advanced, center conductor 210 of cable 200 engages contact member 12. Simultaneously, compression sleeve 14 engages the bottom end 24 of connector body 10 at interface "b," causing compression sleeve 14 and clamping member 16 to compress radially inwardly against insulative sleeve 220. Axial advancement of compression member 18 causes fingers 38 to compress radially inwardly against insulative sleeve 220. Cable 200 is now secured within connector 100.

While I have illustrated and described preferred embodiments of my invention, it is understood that this is capable of modifications, and I therefore do not wish to be limited to precise details set forth, but desire to avail myself of such changes and alterations as fall within the purview of the following claims.

We claim:

1. A connector for connecting an end of a multistranded insulated conductor cable, the cable having a multistranded center conductor surrounded by an insulative sleeve, the connector comprising:

a connector body having a first end and a second end, the first end having defined thereon a threaded portion and the second end having a coaxial bore defined therein;

a contact member located at the first end, the contact member configured to engage the multistranded center conductor;

a conductive pin located within the coaxial bore, the conductive pin configured to establish conductivity between the multistranded center conductor and the equipment terminal;

a compression member having a compression member internal passageway disposed therein, a portion of the internal passageway configured to operate with the threaded portion of the first end of the connector body;

an elastomeric compression sleeve disposed within a portion of the compression member internal passageway, the compression sleeve having a compression sleeve internal passageway disposed therein; and, a clamping member disposed within a portion of the compression sleeve internal passageway, whereby axial advancement of the compression member on the connector body second end simultaneously causes the contact member to engage the multistranded center conductor and the elastomeric compression sleeve and clamping member to compress radially inwardly against the insulative sleeve to secure the cable within the connector.

2. The connector of claim 1, wherein the clamping member has a first diameter and a second diameter, a first sloped surface extending between the first diameter and the second diameter, the sloped surface having a plurality of slots extending from the second diameter toward the first diameter, the first diameter having a flanged portion configured to engage a shoulder on the compression member, the second diameter being smaller than the first diameter.

3. The connector of claim 2, wherein a portion of the compression sleeve internal passageway has a second sloped surface dimensioned to engage the first sloped surface of the clamping member.

4. The connector of claim 1, wherein the compression member is threadably attached to the connector body.

5. A compression member assembly for securing a multistranded insulated conductor cable within a connector, the cable having a center conductor surrounded by an insulative sleeve, the connector having a connector body, the connector body having a coaxial bore disposed therein, a conductive pin located within the bore, a contact member located at one end of the connector body, the compression member assembly comprising:

a compression member attached to the connector body, the compression member having an internal passageway defined therein;

an elastomeric compression sleeve disposed within a portion of the compression member internal passageway, the elastomeric compression sleeve having a first end and a second end and an elastomeric compression sleeve internal passageway defined therein; and, a clamping member disposed within the elastomeric compression sleeve internal passageway, the clamping member having a first diameter and a second diameter, a first sloped surface extending between the first diameter and the second diameter, the second diameter being smaller than the first diameter, whereby axial advancement of the compression member on the connector body simultaneously causes the contact member to engage the multistranded insulated center conductor and the elastomeric compression sleeve and clamping member to compress radially inwardly against the insulative sleeve to secure the cable within the connector.

6. The compression member assembly of claim 5, wherein the first sloped surface has a plurality of longitudinal slots extending from the second diameter towards the first diameter, the clamping member further having a flanged portion configured to engage a shoulder portion of the compression member internal passageway.

7. The compression member assembly of claim 6, wherein a portion of the compression sleeve internal passageway has a second sloped surface configured to engage the first sloped surface of the clamping member.

8. The compression member assembly of claim 7, wherein the compression member is threadably attached to the connector body.

9. A method of securing a multistranded insulated conductor cable within a connector, the cable having a center conductor surrounded by an insulative sleeve, the connector having a connector body, the connector body having a coaxial bore defined therein, a conductive pin located within the coaxial bore, a contact member located at one end of the connector body, the connector further having a compression member assembly comprising: a compression member attached to the connector body, the compression member having a compression member internal passageway defined therein; and elastomeric compression sleeve disposed within a portion of the compression member internal passageway; and, a clamping member disposed within the elastomeric compression sleeve; the method comprising the steps of:

inserting the cable into the compression member assembly;

attaching the compression member assembly to the connector body; and, axially advancing the compression member on the connector body to simultaneously cause the contact member to engage the center conductor and the compression sleeve and clamping member to compress radially inwardly against the insulative sleeve to secure the cable within the connector.

10. The method of claim 9, wherein the step of attaching the compression member assembly to the connector body includes threadably attaching the compression member assembly to the connector body.

11. A connector for connecting an end of a multistranded insulated conductor cable, the cable having a multistranded center conductor surrounded by an insulative sleeve, the connector comprising:

a connector body having a first end and a second end, the first end having defined thereon a threaded portion and the second end having a coaxial bore defined therein;

a conductive pin located within the coaxial bore, the conductive pin configured to establish conductivity between the contact member and the connector body;

a compression member having a compression member internal passageway disposed therein, a portion of the internal passageway configured to operate with the threaded portion of the first end of the connector body;

an elastomeric compression sleeve disposed within a portion of the compression member internal passageway, the compression sleeve having a compression sleeve internal passageway disposed therein; and, a clamping member disposed within a portion of the compression sleeve internal passageway, whereby axial advancement of the compression member on the connector body second end simultaneously causes the contact member to engage the multistranded center conductor and the elastomeric compression sleeve and clamping member to compress radially inwardly against the insulative sleeve to secure the cable within the connector.

12. The connector of claim 11, wherein the clamping member has a first diameter and a second diameter, a first sloped surface extending between the first diameter and the second diameter, the sloped surface having a plurality of slots extending from the second diameter toward the first diameter, the first diameter having a flanged portion configured to engage a shoulder on the compression member, the second diameter being smaller than the first diameter.

13. The connector of claim 12, wherein a portion of the compression sleeve internal passageway has a second sloped surface dimensioned to engage the first sloped surface of the clamping member.

14. The connector of claim 11, wherein the compression member is threadably attached to the connector body.

* * * * *